United States Patent [19]

Tidström

[11] 4,329,909

[45] May 18, 1982

[54] FEEDING DEVICE FOR ROUNDS IN SELF-PROPELLED GUN

[75] Inventor: Erling Tidström, Karlskoga, Sweden

[73] Assignee: Aktiebolaget Bofors, Bofors, Sweden

[21] Appl. No.: 101,399

[22] Filed: Dec. 7, 1979

[30] Foreign Application Priority Data

Dec. 14, 1978 [SE] Sweden ..... 7812841

[51] Int. Cl.[3] ..... F41F 9/04

[52] U.S. Cl. ..... 89/46

[58] Field of Search ..... 89/45, 46, 47

[56] References Cited

U.S. PATENT DOCUMENTS

| | | | |
|---|---|---|---|
| 4,038,906 | 8/1977 | Tidstrom | 89/46 |
| 4,092,901 | 6/1978 | Gustavsson et al. | 89/46 |

FOREIGN PATENT DOCUMENTS

| | | | |
|---|---|---|---|
| 2531936 | 5/1978 | Fed. Rep. of Germany . | |
| 378300 | 8/1975 | Sweden . | |
| 407713 | 4/1979 | Sweden . | |
| 404878 | 1/1934 | United Kingdom . | |
| 481657 | 3/1938 | United Kingdom . | |
| 615043 | 12/1948 | United Kingdom | 89/46 |
| 1251176 | 10/1971 | United Kingdom . | |
| 1380536 | 1/1975 | United Kingdom . | |
| 1520477 | 8/1978 | United Kingdom . | |

*Primary Examiner*—Stephen C. Bentley
*Attorney, Agent, or Firm*—Pollock, Vande Sande & Priddy

[57] ABSTRACT

A self-propelled gun is provided with a magazine arranged on the outside of or in the gun chassis which is then also located at the rear parts of the chassis. The gun is mounted on top of the chassis, so that the gun can be aimed in elevation and/or traverse in relation to the gun chassis. A round carrying part which is arranged in front of the magazine and under the rear parts of the gun is comprised in a device for feeding of ammunition from the magazine to the ramming position at the gun. Said device also comprises a longitudinal displacement mechanism arranged in the magazine for the respective rounds. When the respective rounds are received from the magazine, the round carrying part is set with its longitudinal direction coinciding with the longitudinal direction of the respective round and particularly coinciding with or parallel to the longitudinal axis of the gun. The round carrying part is movably fastened in a unit which can displace the round carrying part in the vertical direction from the feeding position in front of the magazine to the ramming position. Guiding means are arranged to actuate the round carrying part automatically for its setting to the prevailing position of the gun in elevation and/or traverse.

10 Claims, 6 Drawing Figures

FEEDING DEVICE FOR ROUNDS IN SELF-PROPELLED GUN

TECHNICAL FIELD

The present invention relates to a device for feeding rounds in a self-propelled gun from a magazine arranged in or outside the chassis of the self-propelled gun, at its rear parts, to a gun mounted on top of the chassis.

BACKGROUND ART

It is advantageous to utilize the invention for the type of tanks which have a so-called freely suspended magazine at the rear and a gun which can be both elevated and traversed in relation to the chassis. A number of different arrangements for feeding of rounds are known for tanks of this type.

DISCLOSURE OF INVENTION THE TECHNICAL PROBLEM

The known devices for feeding of rounds work with various functioning steps and utilize the longitudinal displacement mechanisms existing within the technology for rounds, hoists, pendulums, etc. A common feature of the known devices is that they are of a comparatively complex construction.

THE SOLUTION

The purpose of the present invention is to solve this problem, and a device is proposed which enables simple and reliable transport of the rounds from the magazine to the ramming position at the gun. The proposal according to the invention is then based upon longitudinal displacement means for the rounds which are known in themselves being utilized in combination with inter alia a specific round carrying part arranged below the rear part of the gun and in front of the magazine, e.g. loading tube, loading tray, etc. Said round carrying part is connected to a unit by means of which the loading tray can be actuated vertically between a position in front of the magazine in the longitudinal displacement direction of the rounds and a ramming position at the rear parts of the gun. The round carrying part is supported in the unit so that in its lowered position it has its longitudinal direction in said longitudinal displacement direction and in the ramming position it is turned sidewise and/or tipped vertically for adaptation to the prevailing direction of the barrel. In accordance with the invention, the setting of the loading tray to the prevailing ramming position is achieved by means of a guiding influence which is affected by specific guiding means.

The distinctive features of the claimed invention will become apparent from a reading of the following portion of the specification.

ADVANTAGES

Through the construction shown, the rounds can be displaced longitudinally in a simple way from a common feeding position in the magazine into a loading channel out into the round carrying unit, which thereafter only need be actuated vertically towards the ramming position, guiding of the round carrying part then taking place automatically by means of said guiding means. In this way, a technically simple, but nevertheless reliably functioning construction for the feeding arrangement is obtained.

In further developments of the concept of the invention entirely mechanical guiding means are proposed which comprise first guiding means which determine the traverse position of the round carrying part in the lower position in front of the magazine, second guiding means which determine the traverse position of the round carrying part at vertical positions different from said lower position, and holding surfaces arranged in the gun jacket by means of which guiding of the round carrying part to the prevailing elevation of the gun takes place. Through the proposed arrangement, the total construction for the round feeding will be advantageous.

BRIEF DESCRIPTION OF DRAWINGS

An embodiment proposed at present of a device which has the characteristics significant for the invention will be described in the following, with reference to the accompanying drawings, in which.

BEST MODE OF CARRYING OUT THE INVENTION

Figure 1:
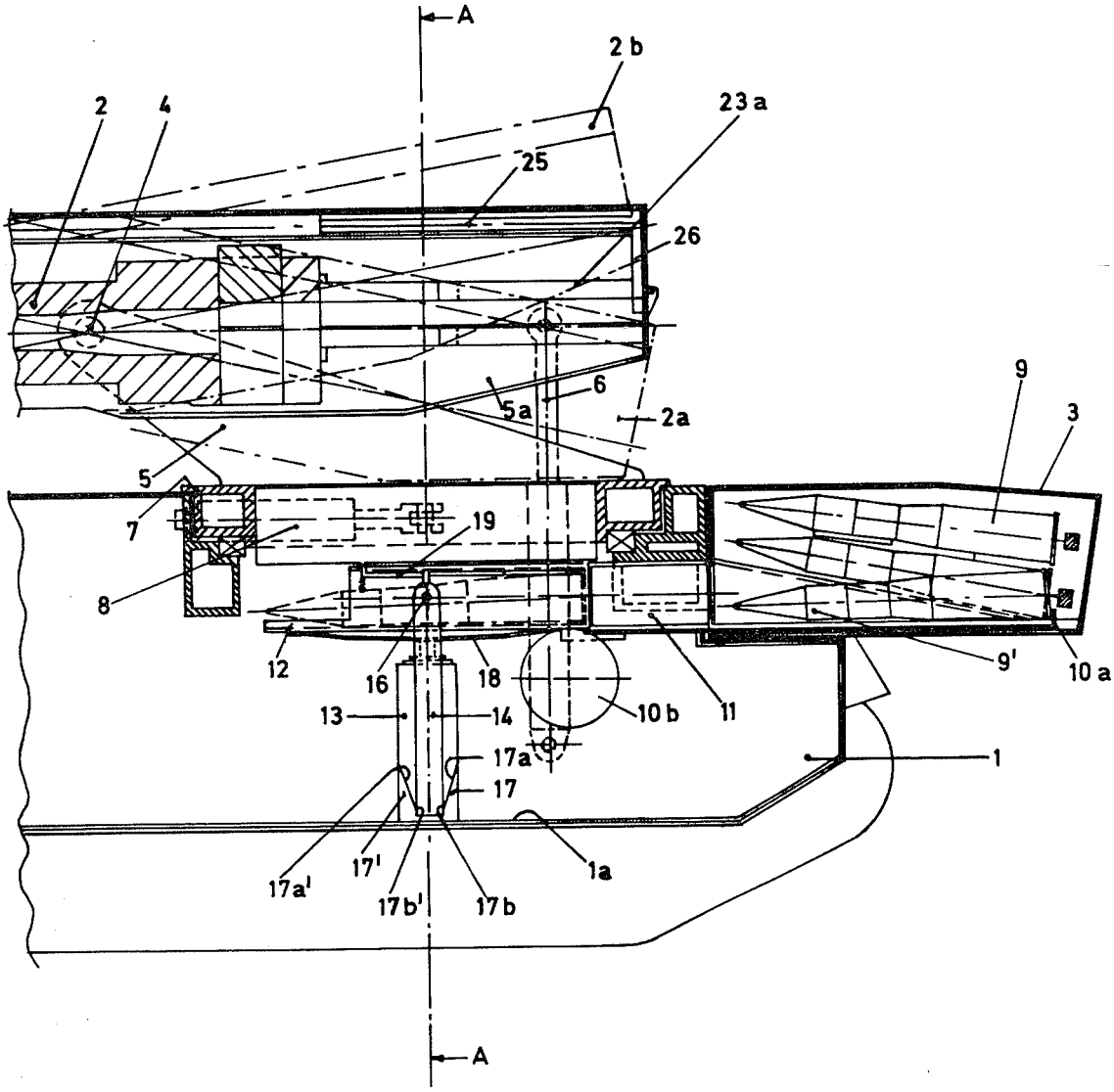
FIG. 1 shows a longitudinal section of the parts concerned of a self-propelled gun utilizing the new feeding devices, the feeding devices then being shown in a first functioning step.
Figure 2:
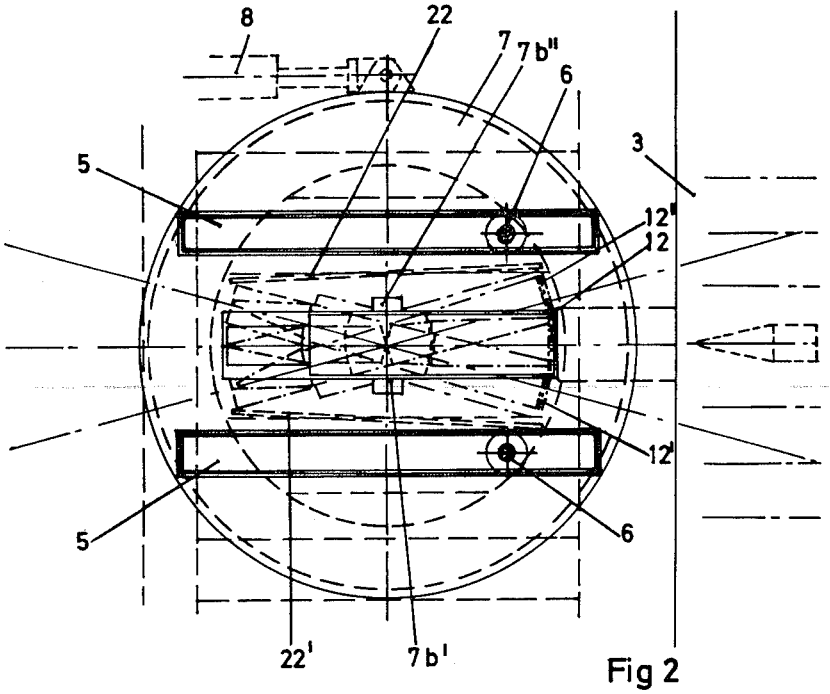
FIG. 2 shows a plan view of certain parts of the parts of the self-propelled gun according to FIG. 1.
Figure 3:
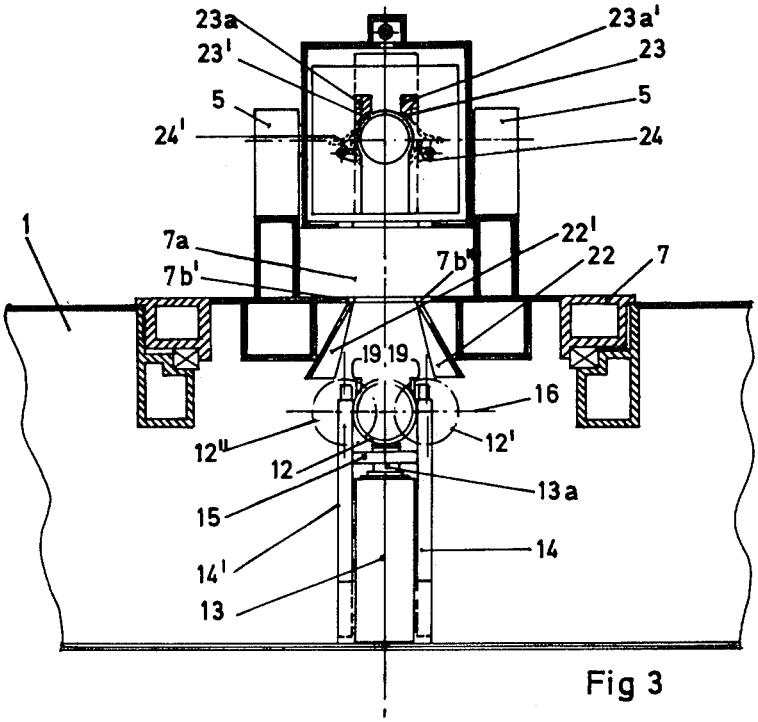
FIG. 3 shows a cross-section of certain parts of the chassis according to FIG. 1.

FIGS. 1, 2 and 3 show parts of a tank which is known in itself which utilizes the new feeding devices. The chassis of said tank is indicated by the numeral 1, and a so-called top mounted gun by 2. At the rear, the tank is equipped with a magazine 3, suspended outside the chassis, at its rear parts. The gun is pivotably suspended in a pivot support 4 comprised in a cradle carrier 5. In said pivot suspension the gun can be elevated and depressed between $+12°$ and $-10°$, the limit positions being indicated in FIG. 1 by 2*a* and 2*b*, respectively. The gun is provided in a way which is known in itself with breech ring, breech block and jacket, the latter having been given the designation 5*a*. The gun can be guided for elevation and depression by means of two elevating cylinders 6.

The cradle carrier is mounted on a rotatable platform 7 arranged at the upper parts of the chassis which enable the gun to be turned $\pm 15°$ in traverse. The turning in traverse is accomplished by means of a traversing cylinder 8.

The magazine is fixed transversally in relation to the chassis, and is of the type which carries rounds 9 in two stories. The magazine is equipped with a cross feeding mechansim which is known in itself which moves the rounds to a common feed-out position. The magazine is also equipped with a longitudinal displacement mechanism which is known in itself which is arranged to move a round 9' which has been moved to the common feed-out position out of the magazine. In FIG. 1, said longitudinal displacement mechanism is designated 10*a*, 10*b*, and can be of the so-called "tape measure type". The longitudinal displacement direction for the respective round is then parallel to or coinciding with the longitudinal axis of the tank. The longitudinal displacement out of the magazine takes place via a loading channel 11.

The feeding out in said longitudinal displacement direction takes place to a round carrying part 12, which can have the form of a loading cradle, loading tube, etc., which is known in itself, arranged in front of and under the rear parts (jacket) of the gun. The round carrying part is arranged at a unit 13 which can displace the round carrying part in elevation or vertically between a lower position where the round carrying part is set in front of the feedout channel with its longitudinal direction coinciding with said longitudinal displacement direction for the respective round and an upper position which corresponds to the ramming position at the firearm.

Said unit 13 has the form of a hydraulic cylinder mounted on the inner floor 1*a* of the chassis. The round carrying part is arranged at a piston 13*a* on said hydraulic cylinder via a rack which comprises two vertically arranged arms or elements 14, 14', which are parallel to each other. The elements are connected together by means of a cross part 15, to the underside of which the piston 13*a* is rigidly fastened. The round carrying part 12 is tiltably supported at the upper parts of said elements 14, 14' around an axis symbolically indicated by 16. The support can consist of a trunnion which is known in itself. At their lower parts, said elements 14, 14' can coact at the lower position of the round carrying part with first oblique surfaces 17*a*, 17*a'* with means 17, 17' so that the round carrying part at its said lower position is guided to a distinct position in the extension of the feed-out channel 11. Said distinct position is achieved by said first oblique surfaces at the bottom assuming the form of two straight surfaces 17*b*, 17*b'* parallel to each other and facing each other which in said lower position of the round carrying part (=the position according to FIG. 1) coact with corresponding surfaces on the element parts in question. A pair of means 17, 17' are arranged on either side of the hydraulic cylinder 13 so that the round carrying part will have good torsional stability in its lower position. The first oblique surfaces are then arranged so that when the round carrying part is lowered to its lower position, they can grip and guide the round carrying part for all differences in the traverse directions that can occur.

Figure 5:
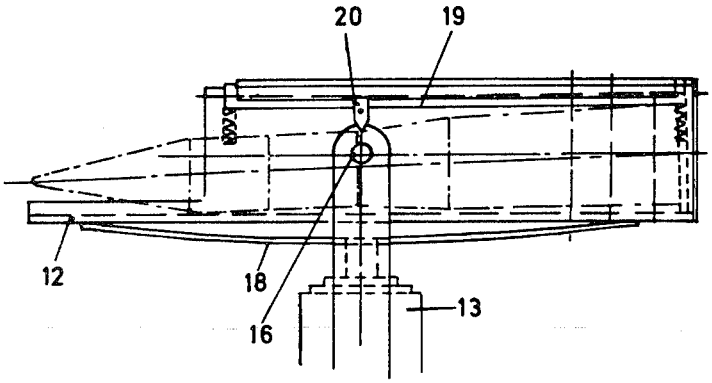
FIG. 5 shows an enlargement of the parts of the feeding devices according to FIG. 1, and FIG. 6 an enlargement of parts of the feeding devices according to FIG. 4.
Figure 6:
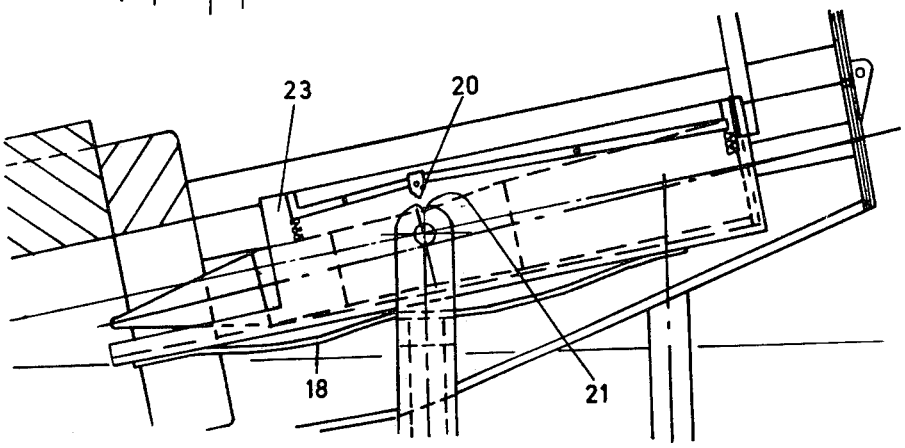

In order to achieve a certain tipping resisting effect for the round carrying part during the feeding out of rounds from the magazine and during the upwards vertical movement, the round carrying part 12 is arranged at said rack by means of tipping resisting means (see also FIG. 5) comprising an elongate plate spring 18 which is fastened to the cross part 15 at its middle parts, and which has its ends fastened to the underside of the round carrying part. The blade spring 18 extends in the longitudinal direction of the round carrying part and the ends of the blade spring are located essentially at the ends of the round carrying part. The tipping resisting means also comprise two jointed stays 19, 19', arranged at the upper side of the round carrying part, and which are parallel to each other and extend in the longitudinal direction of the round carrying part along an essential portion of the round carrying part. The respective stays are rigidly fastened at their ends, and at their middle part, via a joint, support a stud 20, directed downwards, which in the starting position of the round carrying part in the tipping direction is put into coaction with a recess 21 (FIG. 6). Said starting position in the tipping direction corresponds to the position which the round carrying part has e.g. in its lower position which it is given by the unit 13, and which corresponds to the position according to FIGS. 1 and 5. In the example of the embodiment, said starting position corresponds to tipping position 0.

When the round carrying part, due to external forces, obtained from the unit 13 and the holding surfaces on the gun jacket, for example 23, 23', is forced into tipping positions which differ from the starting position, for example the tipping position according to FIG. 6, which corresponds to the maximum depression position, a deformation of the blade spring 18 takes place at the same time as the stud means 20 is moved out of its coaction with the recess 21. When said external forces cease, i.e. when the round carrying part is lowered, the blade spring 18 strives to return the round carrying part to its starting position in the tipping direction, at the same time as the respective stud 20 goes into coaction with the recess 21, so that a distinct starting position is obtained.

In order to obtain a distinct degree of insertion into the round carrying part of the respective round when this is fed in from the magazine, and fixing of the round in the longitudinal direction in the round carrying part, the latter is also provided with blocking means which are known in themselves and are not specially shown, which thus determine the degree of insertion into the round carrying part of the respective round and which also enables rapid feeding out of the respective round in the round carrying part.

Said guiding means also comprise second guiding means in the form of second oblique surfaces 22, 22' arranged at the underside of the platform 7, which are located on plates which extend down from the underside of the platform. Said second surfaces 22, 22', are set obliquely both in the cross-section according to FIG. 3 and in the plan view according to FIG. 2. The oblique setting in the cross-section and the design of the surfaces for the rest are arranged so that the surfaces can grip the round carrying part and guide this to the prevailing traverse position of the gun at all differences which can occur in the traverse directions between the round carrying part in its lower position and the prevailing traverse position of the gun. The maximum differences in the traverse directions for the round carrying part and the gun are shown in the example of the embodiment in FIGS. 2 and 3 by 12' and 12''. The oblique setting in the plan view according to FIG. 2 is due to the design of the respective round, which is wider at the rear than at its front end.

The platform is also provided with a rectangular first through aperture 7*a* which in its plan view has a form corresponding to the plan view of the round carrying part. The platform also has two second through apertures 7*b'*, 7*b''*, which constitute side apertures to said first aperture. Via the second apertures, the elements 14 and 14' respectively, at the actuation of the round carrying part past said first aperture, can go into coaction with the side apertures so that the round carrying part after having been guided into the traverse direction retains the traverse position into which it has been guided during its continued actuation up towards the ramming position.

In connection with the ramming position, the round carrying part goes into coaction with said holding surfaces 23, 23' which are also comprised in said guiding means. If the gun is elevated or depressed, the round carrying part is tipped in its suspension for adaptation in the tipping direction to the prevailing elevation or depression position of the gun, for example in accordance with FIGS. 4 and 6. Said holding surfaces are located on guide rails 23*a*, 23*a'* which are arranged in the gun jacket and extend in the longitudinal direction of this. At the gun jacket there are also arranged spring guide rails 24, 24', extending in the longitudinal direction of the gun, which can be deflected to permit inter alia insertion of the round to the ramming position, and which can spring back in order to hold the round in the ramming position when the unit 13 actuates the round carrying part downwards. Said guide rails also serve as guides for the cartridge case ejection.

Figure 4:
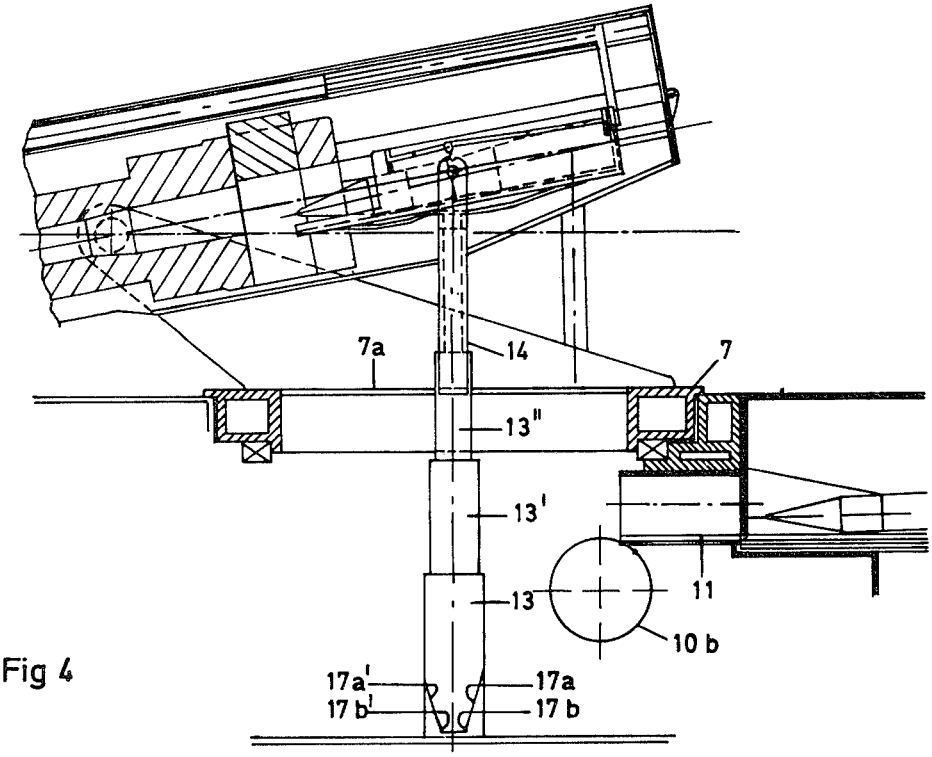
FIG. 4 shows a longitudinal section of the feeding devices according to FIG. 1, but in a second functioning step.

FIG. 4 is intended to show when the round carrying part has been moved up by the hydraulic cylinder 13 into the ramming position from the fetching position in front of the loading channel 11. In order that sufficient raising height shall be obtained, the hydraulic cylinder is of the type which utilizes three telescopically arranged pistons, and in FIG. 4 two lifting pistons have been indicated by 13' and 13'', while the third lifting piston, which in the above-mentioned figure has been given the designation 13*a*, has been drawn with dash lines.

From said ramming position, the round can be moved in a way which is known in itself to its position in the bore of the barrel by means of ramming means which in the example of the embodiment consist of a hydraulic rammer 25 with a rammer tooth 26, which moreover is arranged so that it can be swung out of the way in order to permit cartridge case ejection.

The functioning procedure is briefly as follows. The round in question is moved in the magazine to the feed-out position in front of the loading channel by means of transversal feeding mechanisms in the magazine. The round is displaced longitudinally out of the magazine to its position in the round carrying part 12 which is set in its lower position according to FIG. 1 where it has a traverse position which coincides with the longitudinal displacement direction of the round. The round carrying part is thereafter actuated upwards towards the underside of the rear parts of the gun, during which it is moved through the first aperture in the platform 7 at the upper parts of the chassis. At its passage through the aperture in the platform, the round carrying part is guided to the prevailing traverse position of the gun by the oblique guide surfaces 22, 22'. The guide elements 14, 14' go into coaction with the second apertures 7*b'*, 7*b''* at the first aperture so that the traverse setting obtained by said oblique surfaces 22, 22' for the round carrying part is retained during the continued movement of this towards the ramming position. When the round carrying part has reached the ramming position, it goes into coaction with the holding surfaces 23, 23' in the gun jacket, and the round carrying part is adapted in its tipping direction to the prevailing elevation or depression position of the gun. The spring guide rails 24 at the gun jacket are actuated and grip the round, after which the unit 13 can lower the round carrying part back to the fetching position.

The tipping resisting means in the round carrying part return the latter to its starting position in the tipping direction as soon as the contact with the holding surfaces ceases. The round carrying part is lowered through the first aperture in the platform, and the coaction between the side apertures 7*b'*, 7*b''* and the elements 14 and 14', respectively, ceases. The lower parts of the elements instead go into coaction with the oblique surfaces 17*a*, 17*a'*, so that the round carrying part is guided back to the original traverse position. In the lower position, said lower part has gone into coaction with the surfaces 17*b*, 17*b'* which are parallel to each other so that a distinct traverse position is obtained in said lower position, where a new round can be transferred to the round carrying part, etc.

The invention is not limited to the embodiment shown as an example, but can be subject to modifications within the scope of the concept of the invention.

INDUSTRIAL APPLICABILITY

Certain parts which are comprised in the feeding devices can easily be manufactured and assembled with ready-made components available in the open market, for efficient manufacture for the vehicles concerned.

I claim:

1. In a gun truck having a moveable gun supported in a cradle carrier mounted on a rotatable platform on said truck chassis, a device for individually feeding rounds of ammunition between a magazine and a ramming position located at the immediate rear of said moveable gun, said device comprising:

round carrying assembly means within said truck chassis for vertically lifting a round of ammunition from a predetermined base position aligned with an exit of said magazine and said ramming position;

displacement means for feeding said round of ammunition from said magazine exit onto said carrying assembly means upon arrival at said predetermined base position;

lifting means for lifting said round carrying assembly means and said round of ammunition supported thereon from said predetermined base position to said ramming position, and for returning said round carrying assembly means to said predetermined base portion;

first guiding means for automatically adjusting the elevational orientation of said round of ammunition to correspond to the elevational orientation of said gun upon arrival of said round of ammunition at said ramming position; and, second guiding means moveable with said platform between said predetermined base portion and said ramming position for automatically adjusting the transverse orientation of said round carrying assembly means and round of ammunition supported thereon during vertical movement of said round carrying assembly means toward said ramming position, whereby said round of ammunition assumes a new transverse orientation corresponding to the transverse orientation of said gun upon arrival of said round of ammunition at said ramming position.

2. A device according to claim 1, wherein said round carrying assembly means comprises a loading cradle arranged in a recess in said truck chassis, said cradle having a longitudinal axis aligned with a longitudinal axis of a round of ammunition exiting from said magazine.

3. A device according to claim 1, wherein said lifting means comprises a hydraulic piston and cylinder assembly mounted within said truck chassis, said round carrying assembly means being supported on said piston for joint vertical movement therewith.

4. A device according to claim 3, wherein said lifting means further comprises a rack assembly mounted on said hydraulic piston for joint movement therewith, said rack assembly comprising a pair of vertically extending side members located on opposite sides of said piston and having end portions extending parallel to one another on opposite sides of and pivotally attached to said round carrying assembly means, said rack assembly further comprising a cross member extending between and attached to said vertically extending side members, said cross member supporting said round carrying assembly means and rigidly attached to an end surface of said piston, whereby vertical movement of said piston causes a corresponding vertical movement of said rack assembly as well as said round carrying assembly means.

5. A device according to claim 4, wherein a pair of guide members are attached to said truck chassis on opposite sides of said hydraulic piston, each guide member includes a wedge-shaped opening corresponding in shape to wedge-shaped end portions formed on said vertically extending side members, said guide members being arranged to simultaneously contact said side members as said rack assembly approaches said predetermined base position, wherein said guide members align said rack assembly which, in turn, aligns said round carrying assembly means with said magazine for feeding a further round of ammunition therebetween.

6. A device according to claim 4, wherein said second guiding means comprises a pair of guide walls arranged on opposite sides of said round carrying assembly means with each of said guide walls including surfaces facing toward one another with said round carrying assembly means located therebetween, each of said confronting surfaces having an oblique shape as measured in perpendicular directions along each guide wall, whereby said obliquely-shaped surfaces rotate said round carrying assembly means about an axis extending parallel to the transverse axis of said gun as said round carrying assembly means is vertically lifted between said obliquely-shaped surfaces.

7. A device according to claim 4, wherein said platform includes a pair of apertures each vertically aligned with a rack assembly side member, each aperture being of sufficient size to allow passage of a side member therethrough as said cross assembly is lifted toward said ramming position.

8. A device according to claim 4, wherein tipping resistance means is located between said cross member and said round carrying assembly means for biasing said round carrying assembly means to a predetermined orientation wherein said round carrying assembly means is aligned with said magazine exit.

9. A device according to claim 8, wherein said tipping resistance comprises an elongate blade spring having opposite end portions attached to said round carrying assembly means and having an intermediate portion attached to said cross member, said tipping resistance means further comprising at least one jointed stay disposed adjacent a vertically upper side of said round carrying assembly means, said at least one jointed stay extending parallel to a longitudinal axis of said round carrying assembly means and rigidly fastened at opposite ends to said round carrying assembly means, said at least one jointed stay having stud means extending from an intermediate portion into a recess formed in a surface of one of said vertically extending side members for resisting tipping movement of said round carrying assembly means from said predetermined orientation.

10. A device according to claim 8, wherein said first guiding means comprises a pair of guide rails extending beyond a rear end of said gun for joint movement therewith, said guide rails including holding surfaces confronting said round carrying assembly means and defining said ramming position, wherein said holding surfaces contact and tip said round carrying assembly means into an elevational orientation conforming to said ramming position against the biasing action of said tipping resistance means.

* * * * *